United States Patent [19]

Craig

[11] Patent Number: 4,625,759

[45] Date of Patent: Dec. 2, 1986

[54] GAS RECLAIM BACK PRESSURE REGULATOR

[75] Inventor: David W. Craig, Arbroath, Scotland

[73] Assignee: Alan R. Krasberg, Aberdeen, Scotland

[21] Appl. No.: 748,540

[22] Filed: Jun. 25, 1985

[51] Int. Cl.[4] ..... A62B 7/04

[52] U.S. Cl. ..... 137/613; 137/81.2; 137/494; 137/510; 128/205.24; 251/205

[58] Field of Search ..... 128/205.24, 204.26; 137/DIG. 9, 494, 859, 510, 81.2, 81.1, 613; 251/205

[56] References Cited

U.S. PATENT DOCUMENTS

| | | | |
|---|---|---|---|
| 3,402,711 | 9/1968 | Emerson | 137/494 |
| 3,566,913 | 3/1971 | Parthe, Jr. | 137/494 |
| 3,786,830 | 1/1974 | Owada | 137/494 |
| 3,816,561 | 12/1957 | Krueger | 137/81.1 |
| 3,918,470 | 11/1975 | Jacobellis | 137/510 |
| 3,952,773 | 4/1976 | Hahn | 137/DIG. 9 |
| 3,987,999 | 10/1976 | Savage | 251/205 |
| 4,164,954 | 8/1979 | Ballard | 137/510 |
| 4,219,017 | 8/1980 | Shamlain et al. | 128/205.24 |

*Primary Examiner*—A. Michael Chambers
*Attorney, Agent, or Firm*—Pennie & Edmonds

[57] ABSTRACT

A divers two-stage gas reclaim back pressure regulator is described having mutually concentric side-by-side annular first and second chambers interconnected by a central tubular duct one end of which is cooperable with a first stage diaphragm to form a first stage valve. A third chamber for connection to a gas reclaim line is disposed between the first and second stages and communicates with the latter by way of a plurality of radially-increasing-in-size openings through an annular land of convex configuration on which a second diaphragm seats. A biasing compession spring for the second stage is located in the mentioned tubular duct. An auxiliary closure is provided by a valve element carried on the second diaphragm and capable of seating on the second stage end of the duct. The arrangement is compact, demands relatively low exhalation operation pressure and is tolerant of intruding foreign matter.

8 Claims, 2 Drawing Figures

GAS RECLAIM BACK PRESSURE REGULATOR

BACKGROUND OF INVENTION

This invention relates to a gas pressure regulating valve for use in conjunction with underwater breathing apparatus.

Where the breathable gases supplied to a diver include a reclaimable gas such as helium, then exhaled gases are piped to surface apparatus for extraction of the reclaimable gas in a line at a lower pressure than the divers gas exhalation pressure. A valve usually termed a "gas reclaim" or "gas recovery" valve is used to isolate the divers breating space from the lower pressure in the gas reclaim line. One previously proposed gas reclaim valve is a single stage device having the disadvantage that the divers exhalation effort to operate the valve varies according to the pressure differential with the reclaim line. This disadvantage gives rise to discomfort in breathing; and moreover such a single stage device offers relatively little safeguard against the diver being subjected to reclaim line pressure (suction) in the event of a malfunction. Another previously proposed gas reclaim valve is a two-stage valve, but having the disadvantages of, first, being of unduly large physical dimensions and, second, having a relatively large number of moving components whose total mass is such as to demand undue breathing effort to operate the valve. Moreover, this valve is prone to malfunction in the event of ingress of foreign matter, particles, hair etc.

An object of the present invention is to provide a gas pressure regulating valve for use in conjunction with underwater breathing apparatus in which the aforesaid disadvantages are obviated or mitigated.

According to the present invention, there is provided a gas pressure regulating valve for use in conjunction with underwater breathing apparatus, comprising a first chamber disposed between a first shiftable wall member and a first fixed wall member for receiving exhaled gases, a second chamber disposed between a second shiftable wall member and a second fixed wall member, the first and second fixed wall members defining a third chamber therebetween for connection with a gas reclaim line, and a tubular duct extending from the first chamber to the second chamber through both wall members, said first shiftable wall member cooperating with an adjacent end of said tubular duct to constitute a first stage valve, and said second shiftable wall member cooperating with ports in said second fixed wall member to constitute a second stage valve.

Figure 1:
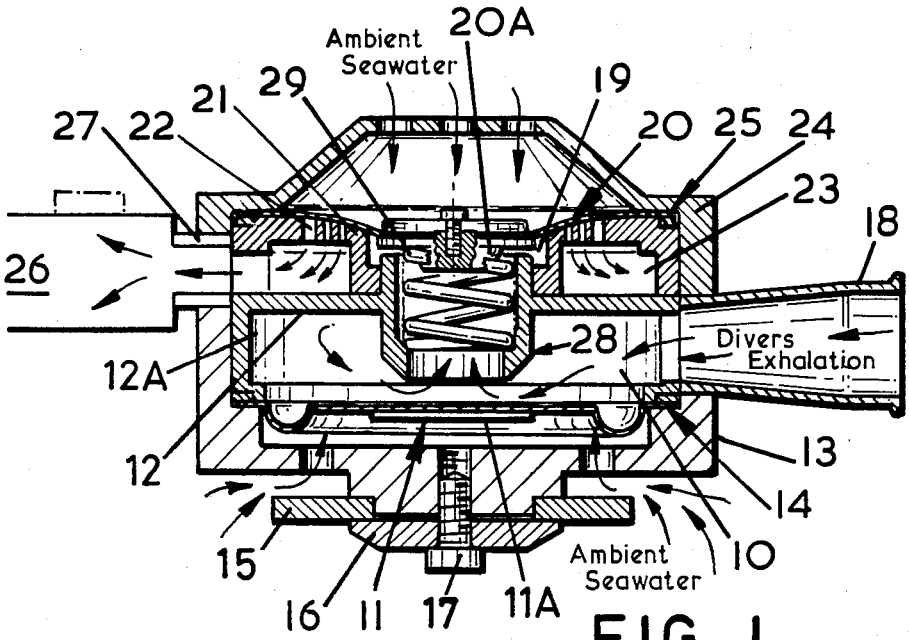
Figure 2:
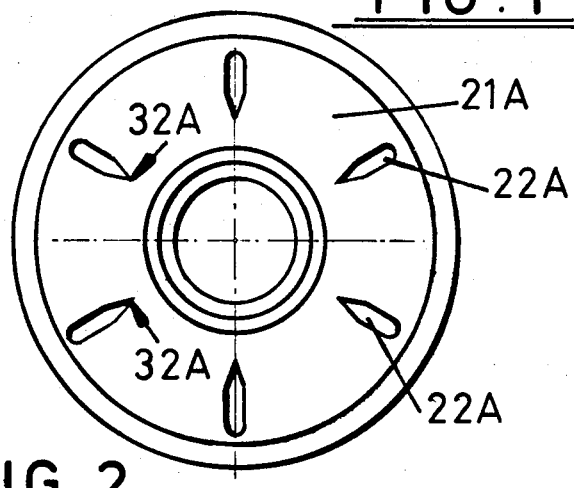

An embodiment of the present invention will now be described, by way of example, with reference to the accompanying drawings in which:

FIG. 1 is a sectional elevation of a gas reclaim valve in accordance with the present invention; and FIG. 2 is a plan view showing a modification of a part of the valve of FIG. 1.

In FIG. 1 a first stage chamber 10 is defined between a first shiftable wall member or diaphragm 11 and a first fixed wall member 12. The wall member 12 is formed integrally with a peripheral skirt portion 12A which fits snugly within a protective outer cup 13 and in cooperation with an annular seal 14 forming the periphery of the flexible diaphragm 11. The outer cup 13 is adapted for mounting on a divers head gear (part of which is represented at 15) by means of a clamp plate 16 and clamp screw 17. The first stage chamber 10 serves to receive divers exhaled gases directly through an inlet tube 18.

A second stage chamber 19 is formed between a second shiftable wall member in the form of a diaphragm 20 and a second fixed wall member in the form of an annular land 21 having a convex surface configuration with which the diaphragm 20 cooperates to cover a plurality of ports or openings 22 communicating with a third chamber 23 disposed between the wall member 12 and the annular land 21. The ports 22 consists of an annnular pattern of circular openings of different sizes of which the smallest are nearer the centre of the annular land 21 so that in use the gas flow rate between the chamber 19 and the chamber 23 is proportional to the degree to which the diaphragm 20 is lifted from its land. The annular land 21 fits snugly within a second outer cup member 24 and cooperates with an annular seal 25 forming the periphery of the diaphragm 20. The chamber 23 communicates with a gas reclaim line 26 by way of an exhaust tube 27 set into the cupped member 24.

The central portion of the diaphragm 11 is provided with a stiffening disc llA; and the central portion of the diaphragm 20 is provided with a circular spring seat and valve disc assembly 20A.

The first stage chamber 10 and the second stage chamber 19 are in mutual communication by way of a tubular duct 28 which extends through the wall member 12 and also through a central opening in the annular land 21. The duct 28 is formed integrally with the wall member 12. The duct 28 houses and locates a biasing compression spring 29 the function of which is explained herebelow. Within the first stage chamber 10 the end of the duct 28 adjacent the diaphragm 11 is cooperable therewith to constitute a first stage valve operable to close passage between chamber 10 and the chamber 19. The assembly 20A of the diaphragm 20 is cooperable with the adjacent (other) end of the duct 28 to constitute an auxiliary closure or valve operable to isolate the chamber 23 from the first stage chamber 10. Under normal operating conditions, as explained herebelow, the assembly 20A stands off from the adjacent end of the tube 28.

The cupped members 13 and 24 are provided with apertures so that surrounding sea water has access to the diaphragms 11 and 20 respectively.

Operation of the gas reclaim valve is as follows. A negative pressure differential of between 10 and 100 feet of sea water is applied to the reclaim line 26. External sea water pressure holds the diaphragm 20 against the annular land 21 to close off the ports 22. Under the action of the biasing spring 29, the chamber 19 is maintained at a negative pressure differential of 0.040 bar. The diaphragm 11 is held against the adjacent end of the duct 28 by external sea water pressure.

Upon the diver exhaling, the outer annular area of the diaphragm 11 is subjected to the exhalation pressure whereupon the diaphragm 11 is lifted from its seating on the adjacent end of duct 28 thereby admitting the exhaled gases to chamber 19. The exhaled gas pressure augmenting the biasing force of the spring 29 effects lifting of the diaphragm 20 which permits flow of exhaled gases into chamber 23 in a progressive manner by virtue mainly of the progressive increase in the size of the ports or openings 22 from which the diaphragm 20 is effectively peeled by the shifting of the assembly 20A. The convex configuration of the annular seat assists the progressive function. Upon cessation of the diver's exhalation, the lower pressure in the reclaim line 26 immediately effects reclosure of the second stage and reseating of the diaphragm 11 against the adjacent end of the duct 28.

In the event of a malfunction causing leakage past the diaphragm 20 towards the chamber 23, the interior of the duct 28 is ultimately closed by seating of the assembly 20A against the adjacent end of the duct 28. Thus, the assembly 20A constitutes an auxiliary closure in conjunction with the seating of diaphragm 11 to isolate the diver from the low pressure in chamber 23 and the reclaim line 26. Upon observing the notably increased exhalation pressure required to operate the reclaim valve, the diver may immediately continue his operations in open circuit mode by isolating the reclaim valve manually.

The disposition of the tubular duct 28 centrally of the vale with respect to the chambers and wall members confers of number of advantages. Since the larger outer annular area of the diaphragm is subjected initially to the divers exhalation pressure, the diaphragm 11 is relatively easily lifted from its seat against the adjacent end of the duct 28. Thereupon, the exhaled gases have direct access to the second stage chamber 19. Thus, the operating effort in terms of exhalation pressure is advantageously low. Since the ports 22 are deployed on a relatively large annular surface, the progressive action of the second stage of the valve is highly reliable. Further, the configuration of the first and second stage valves is such as to be tolerant of intruding particles and other foreign matter.

Modifications within the scope of the appended claims include re-positioning of or dispensing with the biasing spring 29 in which case resiliancy in the diaphragm 20 per se may be used to attain the requisite pressure differential in chamber 19. The assembly 20A may be dispensed with since the reclaim valve described will operate satisfactorily without the facility of the auxiliary closure. The configuration of the annular land 21 may be flat or concave instead of convex, so as to produce a different characteristic of the manner in which gas flow rate changes with lifting of the diaphragm 20. The ports 22 may take the form of slots disposed generally radially and each having an inner end portion configured to define a narrowing or tapering to a tip of negligible radius dimension. The modified port shown in FIG. 2 is given the same reference numerals for the corresponding part in FIG. 1 with the addition of suffix 'A'. In FIG. 2, annular land 21A has a set of six ports 22A disposed radially and each having an inner end portion narrowing to a tip 32A of negligible (in context) radius dimension, for example 0.25 mm. The advantage of this narrowing configuration of the ports 22A is that the "break open" force required to lift the diaphragm (20) from closing engagement with the ports is minimized so that a smooth operation of the second stage of the valve is achieved.

What is claimed is:

1. A two-stage gas reclaim back pressure regulator comprising a composite housing having housing inlet means for connection to a diver's exhalation tube and housing outlet means for connection to a gas reclaim line, said composite housing having (a) a first-stage chamber defined, in part, by a first fixed wall and a first movable wall, said first chamber being in gaseous communication with said housing inlet tube, a first portion of said housing overlying said first movable wall being provided with means defining an opening for permitting seawater access to an outside surface of said first movable wall;

(b) a second stage chamber defined, in part, by a second fixed wall and a second movable wall, said second stage chamber having a center and a periphery and said fixed and said movable walls being disposed between said center and said periphery, said fixed wall having a passageway therein for permitting exhaust gases to pass therethrough, said passageway having a narrower portion in proximity to said center and a wider portion disposed towards the periphery of said chamber, a second portion of said housing having means defining an opening for permitting seawater access to an outside surface of said second movable wall;

(c) a third chamber defined by said first and said second fixed walls and being disposed substantially between said first and second chambers, said third chamber being in gaseous communication with said housing outlet means and with said passageway;

(d) tubular means disposed between said first stage chamber and said second stage chamber for permitting gaseous communication therebetween, said tubular means having a first tube end disposed within said first stage chamber and a second tube end disposed in said second stage chamber;

(e) said first movable wall and said first tube end being cooperable to define a first stage valve, and said second movable wall and said passageway being cooperable to define a second stage valve, the arrangement being such that, in use, said housing is secured to a diver's helmet and the housing inlet means is connected to a diver's exhalation tube and the housing outlet means is connected to a gas reclaim line, and in the absence of exhalation the ambient pressure of seawater acts in said first and said second movable walls to close said first and said second stage valve isolating the diver from negative pressure in the gas reclaim line and said second movable member covers said passageway, and when the diver exhales, said first and said second movable walls are separated from the respective first tube end and said passageway against ambient seawater pressure to open said first and second stages and said second movable wall is removed from said passageway starting at said narrower portion whereby the flow rate of exhalation gases is proportional to the amount the second movable wall is lifted from said passageway, so that the exhalation gases are conducted in sequence, from said first chamber through said second chamber, said passageway, and said third chamber to said gas reclaim line.

2. A two-stage gas reclaim back pressure regulator as claimed in claim 1 wherein said first and said second movable walls are respective first and second flexible diaphragms.

3. A two-stage gas reclaim back pressure regulator as claimed in claim 1 wherein said second fixed wall defines an annular land, said annular land having a convex surface being curved towards said second tube end.

4. A two-stage gas reclaim back pressure regulator as claimed in claim 3 wherein said passageway consists of a plurality of discrete circular openings extending radially in said annular land, at spaced intervals around the circumference of the annular land, the circular openings varying in size with the smallest diameter openings nearest the second tube end and the diameter of said circular openings increasing with distance from the said second tube end.

5. A two-stage gas reclaim back pressure regulator as claimed in claim 3 wherein said passageway consists of a plurality of slots spaced around the circumference of said annular land, each slot extending radially and being proportioned with an inner portion which narrows to a tip of minimal radius dimension.

6. A two-stage gas reclaim back pressure regulator as claimed in claim 1 wherein said second movable wall is coupled to a compression spring disposed within said tubular means, said compression spring being arranged to bias against said second movable wall.

7. A two-stage gas reclaim back pressure regulator as claimed in claim 1 wherein said movable wall member is cooperable with said second tube end of said tubular means to constitute an auxiliary closure preventing gaseous communication between said first and said third chambers.

8. A two-stge gas reclaim back pressure regulator comprising (a) a composite housing having housing inlet means for connection to a diver's exhalation tube and a housing outlet means for connection to a gas reclaim line, said composite housing having a first stage chamber defined, in part, by a first fixed wall and a first flexible diaphragm, said first chamber being in gaseous communication with said housing inlet tube, a first portion of said housing overlying said first flexible diaphragm being provided with means defining an opening for permitting seawater access to an outside surface of said first flexible diaphragm;

(b) a second stage chamber defined, in part, by a second fixed wall in the form of an annular land and second flexible diaphragm, said second stage chamber having a center and a periphery and said annular land and said second flexible diaphragm being disposed between said center and said periphery, said annular land having a plurality of slots spaced around the circumference each slot extending radially and being proportioned with an inner end portion which narrows to a tip of minimum radial dimension for permitting exhaust gases to pass therethrough, a second portion of said housing having means defining an opening for permitting seawater access to an outside surface of said second flexible diaphragm;

(c) a third chamber defined by said first fixed wall and said annular land and being disposed substantially between said first and said second chambers, said third chamber being in gaseous communication with said housing outlet means and with the slots;

(d) tubular means disposed between said first stage chamber and said second stage chamber for permitting gaseous communication therebetween, and said tubular means having a first tube end disposed in said first stage chamber and a second tube end disposed in said second stage chamber, said second flexible diaphragm being coupled to a compression spring disposed within said tubular means, said compression spring being arranged to bias against said second flexible diaphragm;

(e) said first flexible diaphragm and said first tube end being cooperable to define a first stage valve, and said second flexible diaphragm and said slots are cooperable to define a second stage valve, the arrangement being such that, in use, a housing is secured to a diver's helmet and the housing inlet means is connected to the diver's exhalation tube and the housing outlet means is connected to a gas reclaim line, and in the absence of exhalation ambient pressure seawater acts on said first and said second flexible diaphragms to close said first and said second stage valves isolating the diver from negative pressure in the gas reclaim line and said second flexible diaphragm covers said slots, and when the diver exhales said first and said second flexible diaphragms are separated from the respective first tube end and said slots against ambient seawater pressure to open said first and second stages and said second flexible diaphragm is removed from said slots starting at the narrower portion whereby the flow rate of exhalation gases is proportional to the amount the second flexible diaphragm is lifted from the slots so that exhalation gases are conducted, in sequence, from said first chamber through said second chamber, said slots and said third chamber to said gas reclaim line.

* * * * *